US005197211A

United States Patent [19]

Haug

[11] Patent Number: 5,197,211

[45] Date of Patent: Mar. 30, 1993

[54] VEHICLE FOR BEACH CLEANING

[75] Inventor: Walter Haug, Blaustein, Fed. Rep. of Germany

[73] Assignee: Karl Kässbohrer Fahrzeugwerke GmbH, Fed. Rep. of Germany

[21] Appl. No.: 761,904

[22] PCT Filed: Mar. 13, 1990

[86] PCT No.: PCT/EP90/00402

§ 371 Date: Sep. 12, 1991

§ 102(e) Date: Sep. 12, 1991

[87] PCT Pub. No.: WO90/10754

PCT Pub. Date: Sep. 20, 1990

[30] Foreign Application Priority Data

Mar. 13, 1989 [DE] Fed. Rep. of Germany ... 8903085[U]

[51] Int. Cl.[5] ..... E01H 12/00

[52] U.S. Cl. ..... 37/8; 15/84; 15/87; 209/235; 209/421; 171/130; 171/144

[58] Field of Search ..... 37/4, 8, 227; 171/19, 171/126, 130, 131, 144; 289/235, 260, 307, 421, 420; 15/84, 87

[56] References Cited

U.S. PATENT DOCUMENTS

| | | | |
|---|---|---|---|
| 2,976,936 | 3/1961 | Fry . | |
| 3,762,577 | 10/1973 | Olmo et al. | 198/186 X |
| 3,777,327 | 12/1973 | Ellis | 15/84 |
| 4,033,100 | 7/1977 | McRobert | 56/328 R |
| 4,290,820 | 9/1981 | Swigher et al. | 15/83 X |
| 4,482,019 | 11/1984 | Murphy | 171/63 |
| 4,608,725 | 9/1986 | Jackson | 15/3 |
| 4,698,150 | 10/1987 | Wigoda | 37/177.5 X |
| 4,754,521 | 7/1988 | Zoni | 15/340 |
| 4,993,498 | 2/1991 | Fresnel | 37/8 X |

FOREIGN PATENT DOCUMENTS

| | | | |
|---|---|---|---|
| 0277739 | 8/1988 | European Pat. Off. . | |
| 894399 | 9/1953 | Fed. Rep. of Germany . | |
| 1933416 | 3/1970 | Fed. Rep. of Germany . | |
| 2053963 | 6/1971 | Fed. Rep. of Germany . | |
| 2225680 | 12/1973 | Fed. Rep. of Germany . | |
| 2321271 | 10/1974 | Fed. Rep. of Germany . | |
| 2533674 | 2/1977 | Fed. Rep. of Germany . | |
| 3606373 | 10/1987 | Fed. Rep. of Germany . | |
| 2470194 | 5/1981 | France . | |
| 7806886 | 6/1979 | Netherlands . | |
| 1134659 | 1/1985 | U.S.S.R. | 15/84 |

*Primary Examiner*—Randolph A. Reese
*Assistant Examiner*—Arlen L. Olsen
*Attorney, Agent, or Firm*—Samuels, Gauthier & Stevens

[57] ABSTRACT

The vehicle is intended as a self-propelled utility model for beach cleaning. It has a vehicle frame which comprises at least one front and rear axle. A garbage pickup is disposed therebetween. The vehicle is to be a multipurpose vehicle. The vehicle frame equipped with wheels consequently has a centric, rectangular opening between the front and the rear axle. The garbage pickup is adjustably mounted in this opening, namely from an operating position in which it contacts the ground to a ready position in which it is lifted from the ground. Seen in the direction of driving, a collecting receptacle for the picked up garbage is located behind the garbage pickup.

21 Claims, 7 Drawing Sheets

VEHICLE FOR BEACH CLEANING

BACKGROUND OF THE INVENTION

Such a vehicle which can be exclusively used for beach cleaning is known from DE-OS 36 06 373. This vehicle comprises a horizontal pickup roller disposed on the vehicle front which picks up the impurities and delivers them to a barrel-shaped drum sieve via a narrowed chute-like feed. The pickup roller and the drum sieve are mounted pivotably between an operating position in which they contact the ground and a ready position in which they are lifted from the ground by means of a actuating cylinder The garbage is conveyed from the drum sieve via an elevator through an opening in the frame to a collecting receptacle deposited on a frame at the rear of the vehicle.

It is disadvantageous in the known vehicle that only a relatively narrow chute duct to the drum sieve is formed although the pickup roller extends across the entire width of the vehicle Larger garbage components can get jammed in this bottleneck during transport of the garbage in the direction towards the collecting receptacle and get stuck there This effect is increased by the use of a drum sieve disposed downstream, since the garbage is not distributed on a large surface, but is substantially only conveyed along the deepest area within the drum. Due to the insufficient distribution of the garbage, the separation of sand from garbage is also rendered difficult. The volume of the collecting receptacle is furthermore relatively small so that the beach cleaning must be interrupted frequently to empty the collecting receptacle at a garbage transfer station. This leads to an increased work expenditure and to a prolongation of the work input during beach cleaning It is also disadvantageous that an exchange of pickup roller and drum sieve is hardly possible to equip the vehicle possibly without the two or with another pickup roller or drum sieve Since the loading area above the vehicle frame is fundamentally only designed to receive the collecting receptacle, it can also not be used for different fields of application.

SUMMARY OF THE INVENTION

The invention is based on the object of providing a vehicle of the type indicated at the beginning, which can be used for many purposes and which is in particular improved regarding the garbage pickup.

The garbage can be conveyed in simple fashion to the elevator via the pickup V-ledge of the garbage pickup. Larger garbage components can also be picked up without problems. The elevator conveys the garbage picked up rapidly and across its entire width to the conveyor means. A separation of sand and garbage takes place both by means of the elevator and the conveyor means. The garbage located on the conveyor means is delivered to the garbage pickup located at the rear of the vehicle. Bottlenecks do not occur in this type of garbage pickup Due to the detachable arrangement of the garbage pickup below the loading area, it can moreover be detached in simple fashion or exchanged against another garbage pickup. Depending on the field of application a garbage pickup with another pickup V-ledge and/or another elevator can e.g. be fastened to the vehicle. Due to the arrangement of the garbage pickup below the loading area, the loading area can be used for the most different fields of application. The loading area can in particular also serve to receive the garbage collected in the collecting receptacle. Due to this the application time of the vehicle is considerably prolonged.

Due to the garbage pickup mounted adjustably and/or pivotably on the frame a use of the vehicle is not limited to beach cleaning. The vehicle can also be used as tractive machine in road traffic with the garbage pickup pivoted away from the ground. Due to this, a variable application, in particular for municipal works, results. Different attachment devices can be optionally attached detachably to the front and rear of the vehicle such as blade grass cutter, motorized grass cutter, sockle-bar grass cutter, shredding device, sweeping machine, rotary brushes for the cleaning of guide posts and guardrails, snow plough, salt spreader, fertilizer spreader, soil ventilating devices or the like. The vehicle may also have attachment devices such as special facilities for the transport of wicker beach chairs and water reservoirs or the like.

A matching between the width of the garbage pickup and the width of the central strip is important because due to this the entire garbage deposited in the central strip can be picked up and transported away. A penetration into a sandy ground and thus a picking up of garbage pressed into the ground is possible by means of the pickup V-ledge. It is advantageous that only the garbage is picked up from the ground, while the sand is partly already deposited on the V-ledge By means of a variation of the working depth by means of the actuator objects pressed more deeply into the ground can also be removed from it. Due to the design of the elevator with deflecting axes and a rotating end a rapid picking up and transporting away of the garbage to the collecting receptacle is ensured.

A large separation of the garbage from the ground material carried along is possible by means of the conveyor means. A jumping off or sliding off of the garbage due to the conveying movement of the riddle sifter is prevented by means of a rearwardly rising riddle sifter. It is furthermore also suitable to dispose the collecting receptacle at the rear of the vehicle, since it is easily accessible in this position and can also be used as a deposit for other objects if the vehicle is used for municipal tasks other than beach cleaning.

By means of lateral connecting rods, the eccentric mounting of the horizontal swivelling axes and by suited stops an automatic emptying of the full collecting receptacle over the loading area is possible by means of a tilting of the receptacle in the case of a pivoting of the collecting receptacle over the loading area. The tilting point of the collecting receptacle can be varied by means of the additional actuator in order to achieve a uniform filling of the loading area. If the rear wall is designed in parallel to the bottom in a collecting receptacle, a direct picking up e.g. of sand is ensured in the case of a backing up of the vehicle and subsequent putting upright of the collecting receptacle by means of the actuator. A level indicator and an indicator means may also be advantageous, since the collecting receptacle can normally not be seen from the driver's seat.

Finishers may be provided at the rear of the collecting receptacle and/or at the vehicle frame for the smoothing of the cleaned sand and for a certain levelling out of hollows and holes in an embodiment of the invention.

Due to the invention a targeted depositing of the garbage received in the collecting receptacle is possible and, in addition to this, a multiple use of the vehicle, e.g.

for transporting building materials, soil, gardening articles or the like.

A cleaning not only of one area in the center of the vehicle, but also in the tracks of the wheels is possible by means an advantageous embodiment of the invention. A rational cleaning of a specific beach area results from this, since a strip corresponding at least to the vehicle width can be cleaned per working cycle. The track cleaning device can have a number of cleaning elements which are attached to the vehicle in rapidly mountable and retrofittable fashion by means of a common carrier. Swath rotors driven in counter-rotation, coiled worms or brush rollers can e.g. be used as cleaning elements. The cleaning elements can be designed lowerable into an operating position and liftable into a ready position by means of actuating devices.

Features of the track cleaning device are furthermore advantageous since e.g. in the case of rough ground too deep a penetration of the cleaning elements into the ground and possibly their damaging is prevented by means of the guide shoes supported flatly on the ground. Guide shoes designed in disk-shaped fashion make moreover a sliding in all horizontal directions possible. Such a shock absorption of the cleaning elements by the guide shoes increases the durability and thus the service life of the cleaning elements, in particular in the case of the cleaning of hilly ground. The guide shoes can be vertically adjustable with respect to the penetration depth of the cleaning elements, whereby a large adaptation to the condition of the ground to be cleaned is given.

By means of a detachable quick-acting closure a retrofitting of the vehicle to other fields of application is ensured without great time expenditure, by simple manipulations and without special expert knowledge. The variability and flexibility of the utility vehicle is still increased by this.

Examples of embodiment of the subject matter of the invention are explained in greater detail in the following by means of the drawing.

DETAILED DESCRIPTION OF PREFERRED EMBODIMENT

Figure 1:
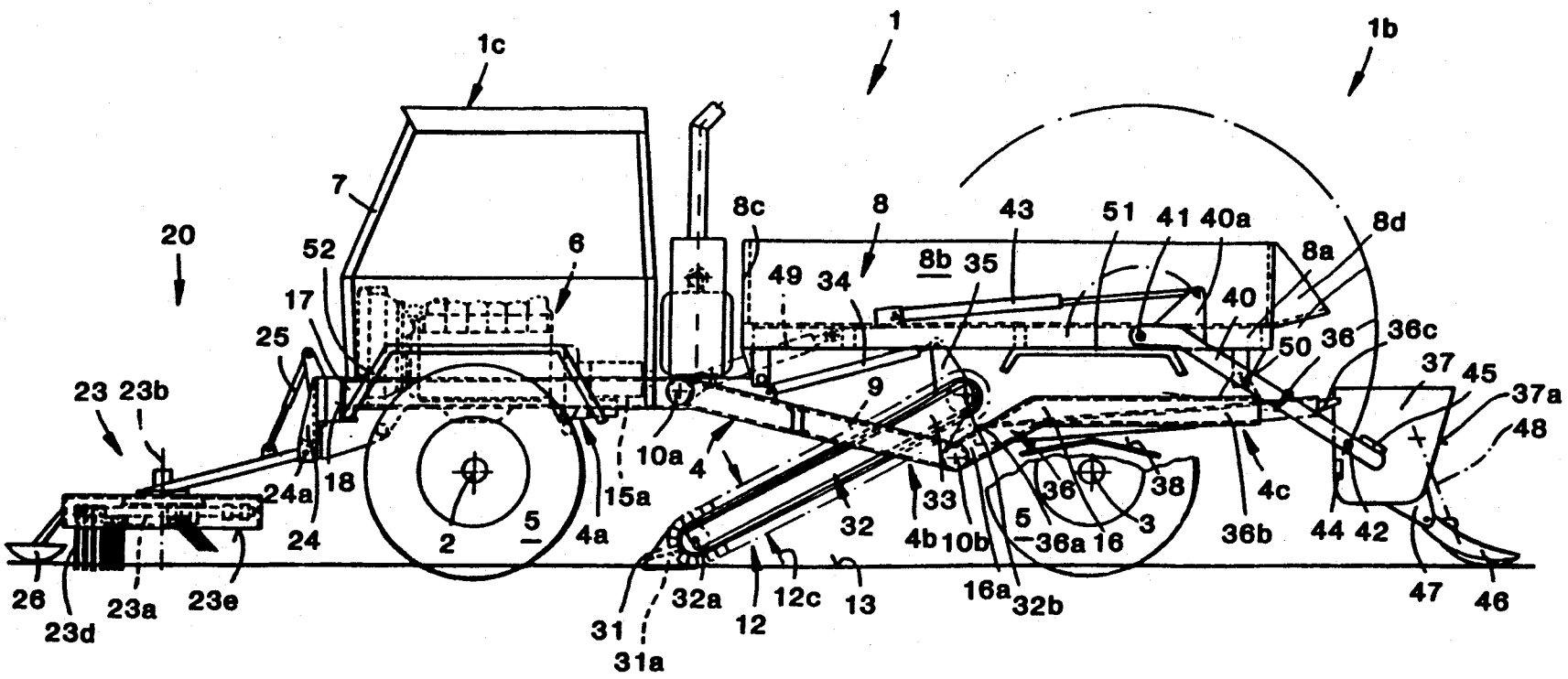
FIG. 1 shows a lateral view of a utility vehicle for beach cleaning in its operating position.

A self-propelling utility vehicle for beach cleaning 1 is presented in FIG. 1 in its operating position. The utility vehicle 1 has a front axle 2 and a rear axle 3, on which a vehicle frame 4 is resiliently mounted. The ends of the axles are equipped in each case with at least one vehicle wheel 5. A driving motor 6 of a conventional construction, e.g. a hydraulic drive, acting on one or both axles is provided above the front axle 2, which moreover can also drive further devices installed on the vehicle. The front part of the vehicle, in particular above the front axle 2 is surrounded by a driver's cabin, while the part of the utility vehicle 1 disposed behind the driver's cabin 7 has a tiltable loading area 8.

The vehicle frame 4 consists of a front, **4*a*, central, 4*b*, and rear section 4*c*. The central section 4*b* has a centric rectangular opening 9, which is limited by two spaced transverse bars 10 extending transversely to the longitudinal direction of the vehicle and by two spaced longitudinal bars 11 extending in the longitudinal direction of the vehicle, whose ends are in each case connected with the transverse bars. A garbage pickup 12 is adjustably mounted in the opening 9, which can be pivoted from an operating position in which it contacts the ground 13 (cf. FIG. 1) into a ready position, in which it is lifted from the ground (cf. FIG. 7**) and vice versa.

Figure 2:
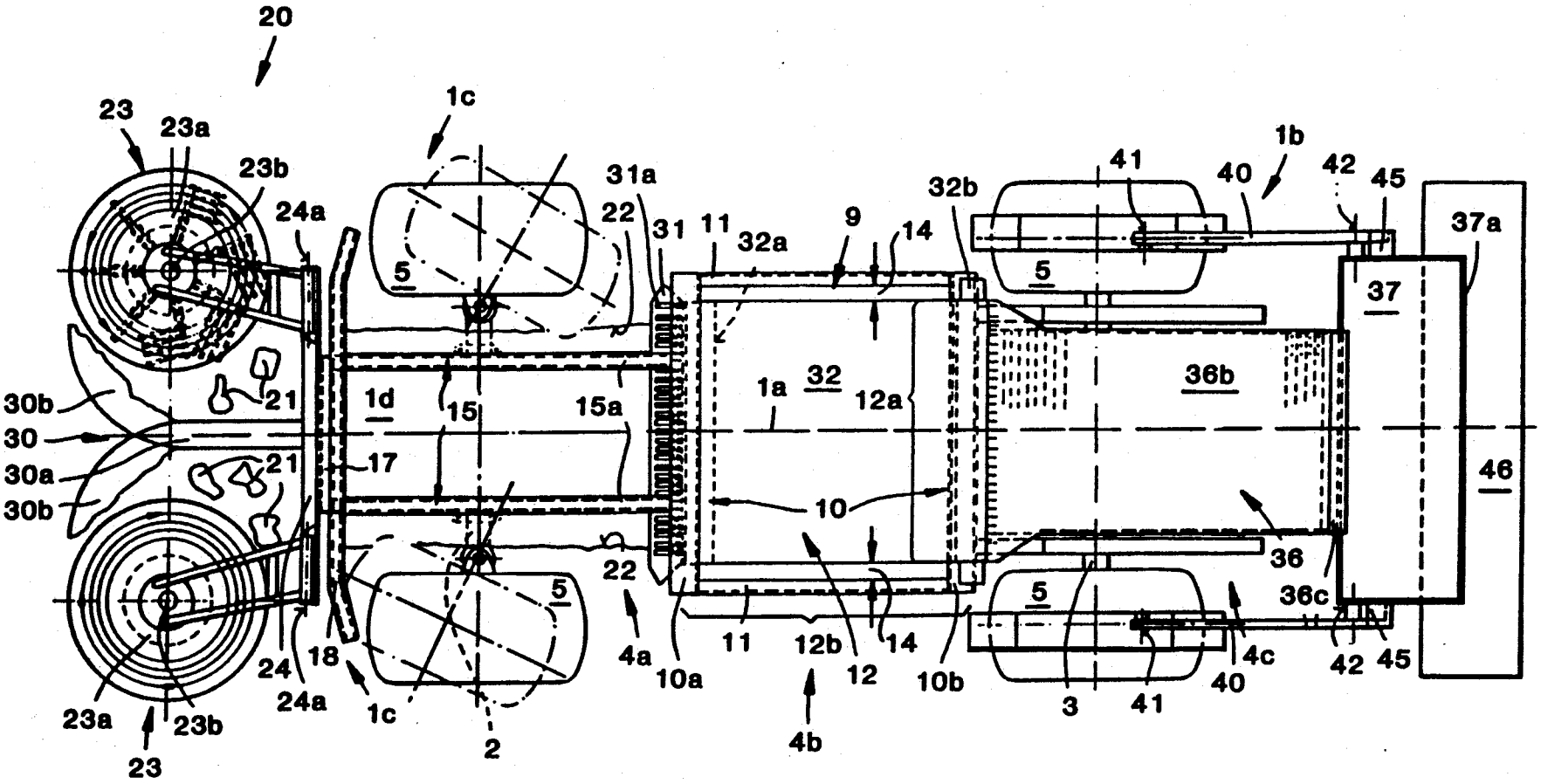
FIG. 2 shows a top view of the utility vehicle represented without superstructure.

The front and rear transverse bars **10*a*, 10*b* have an identical length, which exceeds the width 12*a* of the garbage pickup 12 in such fashion that there is a clearance 14 of approximately identical size between the garbage pickup 12 and the longitudinal bars 11 (cf. FIG. 2). The length of both longitudinal bars and thus the inner distance between the transverse bars 10 corresponds approximately to the length 12*b*** of the garbage pickup.

The front section **4*a* of the vehicle frame has two spaced front longitudinal axle bars 15 extending in the longitudinal direction of the vehicle, which are disposed symmetrically to the longitudinal axis of the vehicle 1*a* and whose rear ends 15*a* are connected at the front side with the front transverse bar 10*a*. The rear section 4*c* of the frame also has to spaced rear axle longitudinal bars 16 extending in the longitudinal direction of the vehicle, which are also disposed symmetrically to the longitudinal axis of the vehicle 1*a* and whose front ends 16*a* are connected with the rear transverse bar 10*b*. According to FIG. 2 the distances of the front and rear longitudinal axle bars 15, 16 have in each case a different dimension with respect to each other. As regards the front longitudinal axle bars 15 their inner distances results from the length of the transverse bars 10 reduced by about double the width of the vehicle wheels 5. The front ends of the front longitudinal axle bars 15 are connected with each other by means of a front support 17, whose length corresponds approximately to the inner distance of the front longitudinal axle bars 15 from each other. An attachment plate 18 is fastened to the front side of the front section 4*a*** of the vehicle frame, which may also be designed as bumper and can receive e.g. the vehicle headlamps (not shown).

According to FIGS. 1 and 7 to 9 the vehicle frame 4 is bent in inclined fashion towards the rear of the vehicle in its central section **4*b*, i.e. in the area of the opening 9, so that the rear transverse bar 10*b* has a smaller ground clearance than the front transverse bar 10*a*. Thus the inclination of the central frame section 4*b* is selected in such fashion that the difference of the ground clearance of the transverse bar corresponds approximately to the height 12*c* of the garbage pickup and the ground clearance of the rear transverse bar 10*b* is at least as large as the ground clearance of the rear axle 3. The front ends 16*a* of the rear longitudinal axle bars 16 are bent in inclined fashion towards the rear transverse bar 10*b* in such fashion that the bending point is disposed before the rear axle 2 and the section of the rear longitudinal axle bar 16** disposed behind the bending point are disposed approximately horizontally.

A track cleaning device 20 is provided at the front side 1*c* of the utility vehicle 1, which is driven e.g. by the driving motor 6, which conveys the garbage located in the track towards the center 1*d* of the vehicle so that the garbage 21 is conveyed to a central strip 22 located below the utility vehicle 1. The track cleaning device 20 has according to FIG. 2 a separate cleaning element 23 for each track which is mounted above a common support 24 on the front side 1*c* of the vehicle. The support 24 extends in horizontal direction transversely to the driving direction and has swivelling axes 24*a* at its ends, on which the cleaning elements 23 are mounted pivotably in vertical direction . An actuation means 25 is provided between the common support 24 and the cleaning element 23, by means of which the cleaning elements can be moved individually or separately from each other from an operating position in which they contact the ground 13 into a ready position in which they are lifted from the ground and vice versa. FIG. 2, in particular, shows cleaning elements 23 designed as swath rotors 23*a*, which have in each case a vertical axis of rotation 23*b* and are driven in counter-rotation. The swath rotor disposed on the left in the driving direction has a clockwise direction of rotation, the swath rotor disposed on the right in the driving direction has a counter-clockwise direction of rotation. As can be seen from FIGS. 2 and 3 the swath rotor 23*a* consists of circular swath rakes, which have a diameter corresponding at least to the track width.

To dampen roughnesses of the ground and to adjust the penetration depth of the circular swath rakes in the ground 13 vertically adjustable guide shoes 26 are fastened to the cleaning elements 23. They are of a disk-shaped design and are disposed outside the working range of the circular swath rakes or in the area of the axis of rotation 23*b* (cf. FIG. 3).

The circular swath rakes are provided with tines 23*d* which have a bend in their longitudinal axis which points contrary to the direction of rotation (not represented in greater detail). Due to this the tines are adjusted at a drag angle to the ground 13. The height of the tines is variable within wide limits and is up to 0.5 m.

Figure 3:
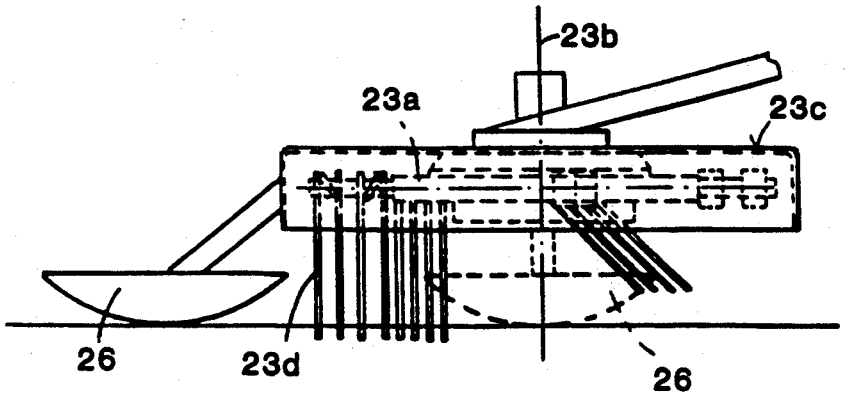
FIG. 3 shows an enlarged lateral view of a first embodiment of the track cleaning device.

As is shown in greater detail in FIGS. 1, 2 and 3 the circular swath rakes can be pivoted by means of a control, e.g. a link control, from an operating position in which they contact the ground 13 into a ready position in which they are lifted from the ground and vice versa during a rotation by 360°. The control is designed in such fashion that the circular swath rakes being just located in the rear part of the swath rotor, i.e. the part pointing towards the vehicle, are lifted, while the circular swath rakes just located in the front part of the swath rotor are adjusted towards the ground. Each cleaning element 23 is moreover provided with a guard hood, which may also be of a diffusorlike design, i.e. designed like an aerodynamic conveying duct (not represented in greater detail). The outwardly directed opening of the conveying duct is aligned towards the center of the vehicle and opens, as tangentially as possible, in the central strip 22.

Figure 4:
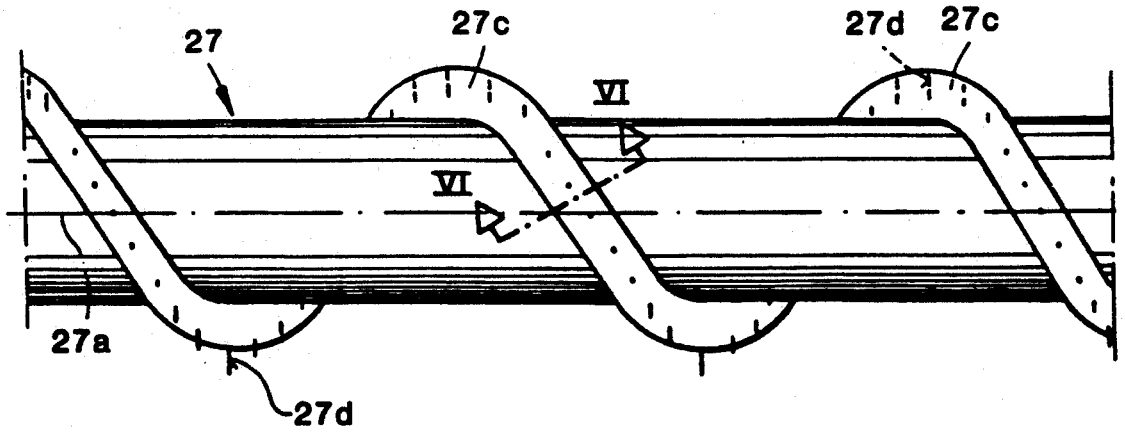
FIG. 4 shows a front view of part of a second example of embodiment of the track cleaning device.
Figure 5:
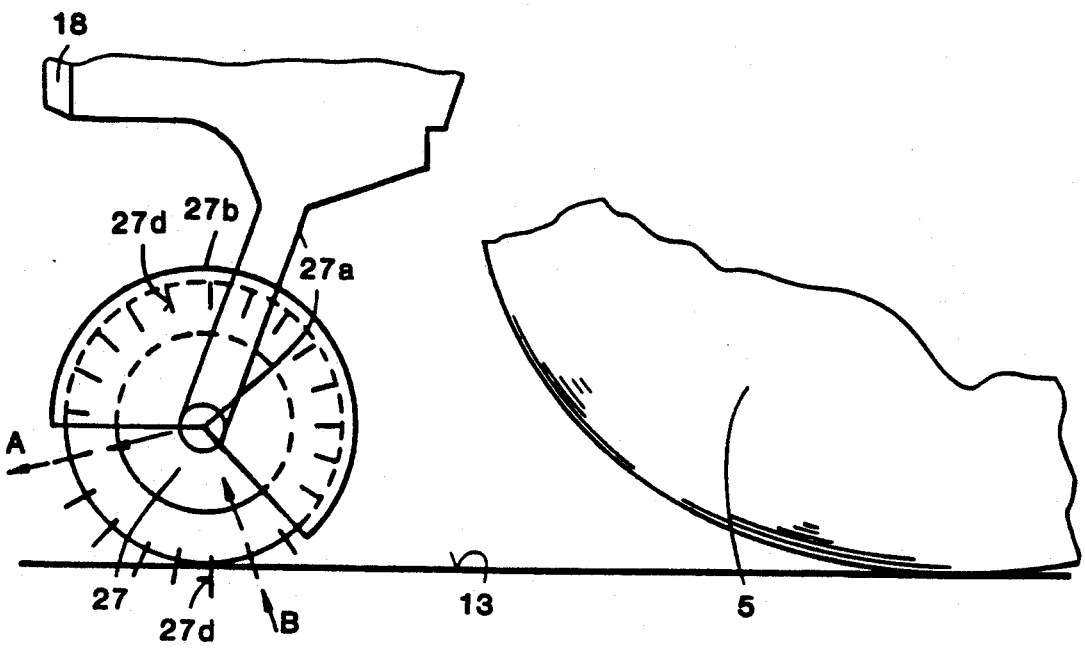
FIG. 5 shows a lateral view of the track cleaning device according to FIG. 4.
Figure 6:
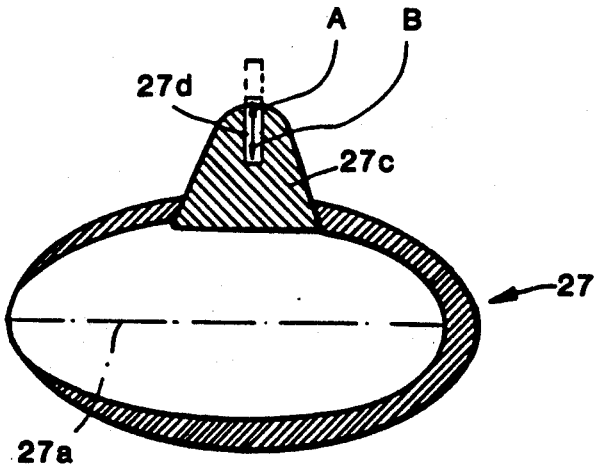
FIG. 6 shows a section along line VI—VI of FIG. 4.

A further embodiment of the track cleaning device 20 is represented in FIGS. 4 to 6.

According to this embodiment the track cleaning device 20 is designed as worm 27 coiled in opposite directions with a worm axis 27*a* extending transversely to the longitudinal direction of the vehicle. It is possible to design the worm across the entire width of the vehicle and to provide it with opposed spirals or to provide a separate spiral in each track (cf. FIG. 4) which conveys the garbage from the outer side of the track to the central strip located below the vehicle. To achieve this purpose the direction of rotation of the worm must be accordingly selected. According to FIG. 5 the worm 27 is directly disposed before the vehicle wheel 5 and provided with a guard hood for the purpose of a targeted conveying of the garbage. To increase the conveying capacity a worm rim 27*c* rotating on the worm has tines 27*d*, which are adjustable in their longitudinal direction or transversely to it from an operating position to a ready position and vice versa during a 360° rotation by means of a control means (not shown). The control means is designed in such fashion that tines 27*d* are retracted in the upwardly pointing section of the worm 27 towards the worm axis 27*a* while they are radially outwardly displaced in the worm half pointing to the ground in the direction towards the ground 13 and in the direction of the garbage to be conveyed. Therefore a radially outwardly movement of the tines 27*d* takes place at first place in the lower worm half pointing towards the ground 13 (cf. arrow A in FIGS. 5 and 6 and finally after the passing of the lower dead center a movement of the tines directed towards the worm axis 27*a*, i.e. inwardly, takes place (cf. arrow B in FIGS. 5 and 6). In the case of the design of the track cleaning device as a worm an actuating device can also be provided, by means of which the distance of the worm 27 from the ground 13 or its penetration depth into the ground can be adjusted and varied The track cleaning device 20 can furthermore be designed in the form of a brush roller with vertical and/or horizontal axis of rotation.

As represented in FIG. 2 a baffle plate or deposit plate 30 represented in partly broken fashion is disposed between the cleaning elements 23. The baffle plate can also be shaped in such fashion that it has a portion 30*a* extending in the longitudinal direction 1*a* of the vehicle and tangentially is phased out towards the cleaning elements 23. The portion pointing towards the cleaning elements 23 may also phase out into the guard hood 23*e* of the cleaning elements or act itself as a guard hood.

In the following the garbage pickup 12 is explained in greater detail with reference to FIGS. 1, 2 and 7. The width 12*a* (cf. FIG. 2) of the garbage pickup should at least correspond to the width of the central strip 22 in order to make a proper garbage pickup possible. The garbage pickup consists substantially of a pickup V-ledge 31 and an elevator 32 guided around two deflection axes 32*a*, *b* and disposed behind the pickup V-ledge 31. The pickup V-ledge 31 consists of spaced pickup elements 31*a* of an almost triangular design (cf. FIG. 2) which may also be designed in tooth-shaped fashion and/or pointing tangentially to the ground 13.

The pickup V-ledge 31 is kept near the ground 13 or guided through the ground, e.g. sand, with a specific penetration depth in the operating position of the garbage pickup 12 (cf. FIG. 1). The penetration depth of the pickup V-ledge 31 is several cm, preferably about 5 cm. Therefore the front deflection axis 32*a* is disposed near the ground and the rear deflection axis 32*b* is disposed at a distance from the ground in the operating position, the latter being disposed above the rear transverse bar 10*b* and/or above the rear axle 3 of the vehicle.

The elevator 32 has an upper and lower carrying run extending in each case between the deflection axis 32*a*, 32*b*, the axis of rotation of the deflection axes being selected in such fashion that the upper carrying run extends rearwardly and the lower carrying run extends forwardly. The direction of rotation of the elevator in FIG. 1 corresponds to a clockwise rotation. The elevator 32 can be designed very differently as a function of the garbage to be picked up, preferably as conveyor. belt, scraper floor, a raking belt or link conveyor The rotating carrying run may moreover have a surface coating or specially designed grippers which allow a reliable gripping, picking up and conveying of the garbage. At least one of the deflection axes, preferably the upper deflection axis 32*b*, is designed as a driving axle and driven via the driving motor 6 or a separately provided motor.

The lateral ends of the upper deflection axis 32*b* are rotatably mounted in a supporting arm 33 supported in each case on the longitudinal bar 11. An actuator 34, e.g. a piston/cylinder unit, is provided between the vehicle frame 4 and the upper end of the garbage pickup 12, which is connected detachably with the central section 4*b* of the frame at one end and with a swivelling arm 35 fastened to the upper end of the garbage pickup at the other end. A pivoting of the garbage pickup 12 in the opening 9, i.e. a regulation of the working depth, and a moving of the garbage pickup from the ready to the operating position and vice versa is possible by an actuation of the actuator. The garbage pickup is pivoted about the deflection axis 32*b* held in the supporting arm 33. It follows from this that the upper deflection axis 32 is held stationarily, while the position of the deflection axis 32*a* between the ground 13 and approximately the ground clearance of the front transverse bar 10*a* is variable.

Adjoining the garbage pickup 12 a conveyor means 36 is provided which conveys the garbage delivered by the garbage pickup 12 to a collecting receptacle 37 attached to the rear 1*b* of the vehicle. The conveying means 36 has a stopper strip 36*a* (cf. FIG. 1) in its front part, which can also be designed as a stripper for detaching the garbage located on the elevator 32. The conveyor means 36 can be driven by means of a motor and is preferably designed as a horizontal or rearwardly rising riddler 36*b* or as a horizontal conveyor belt. The riddler 36*b* is suspended elastically on the rear section 4*c* of the frame or near the rear axle 3 and is caused to move by means of an eccentric drive, e.g. a static displacement drive. The conveyor belt is conventionally provided with two deflection axes, one of which being at least driven. In order to prevent a rolling off of the garbage from the garbage pickup 12 and the conveying means 36, they may be provided with lateral collecting sheets (not shown).

A delivery strip 36*c* made of rubber is provided at the end of the riddler 36*b*, by means of which the garbage is introduced into the collecting receptacle 37.

A baffle plate 38 is disposed between the conveying means 36 and the rear axle 3, which can also be moved in the direction of conveying of the riddler 36*b* (cf. FIG. 1).

The collecting receptacle 37 is held on the vehicle frame 4 or on the loading area 8 by means of two lateral connecting rods 40. Each connecting rod 30 is rotatably mounted on the loading area 8 via a horizontal swivelling axis 41 at one end and on the collecting receptacle 37 also via a horizontal swivelling axis 42 at the other end in FIGS. 1, 2, 7 to 9. An actuator 43, e.g. a piston/-cylinder unit, is allocated to each connecting rod 40, whose one end is detachably held with a side wall of the loading area 8 and whose other end is detachably held with a pivoting arm 40*a* fastened in each case to the connecting rods 40. The collecting receptacle 37 is preferably designed as a tilting trough, the swivelling axes 42 being disposed before the center of gravity of the collecting receptacle 37.

Stops 44, 45 are in each case provided on the side walls of the collecting receptacle below and at the level of the swivelling axes 42, which limit the swivelling path of the rear end of each connecting rod disposed downstream of the swivelling axis 42. The rear end of the connecting rod 40 finally cooperates with the stop 44 upon an actuation of the actuator 43 and a circular upwardly directed pivoting movement of the connecting rods 40 and of the collecting receptacle 37 about the swivelling axis 41.

Figure 7:
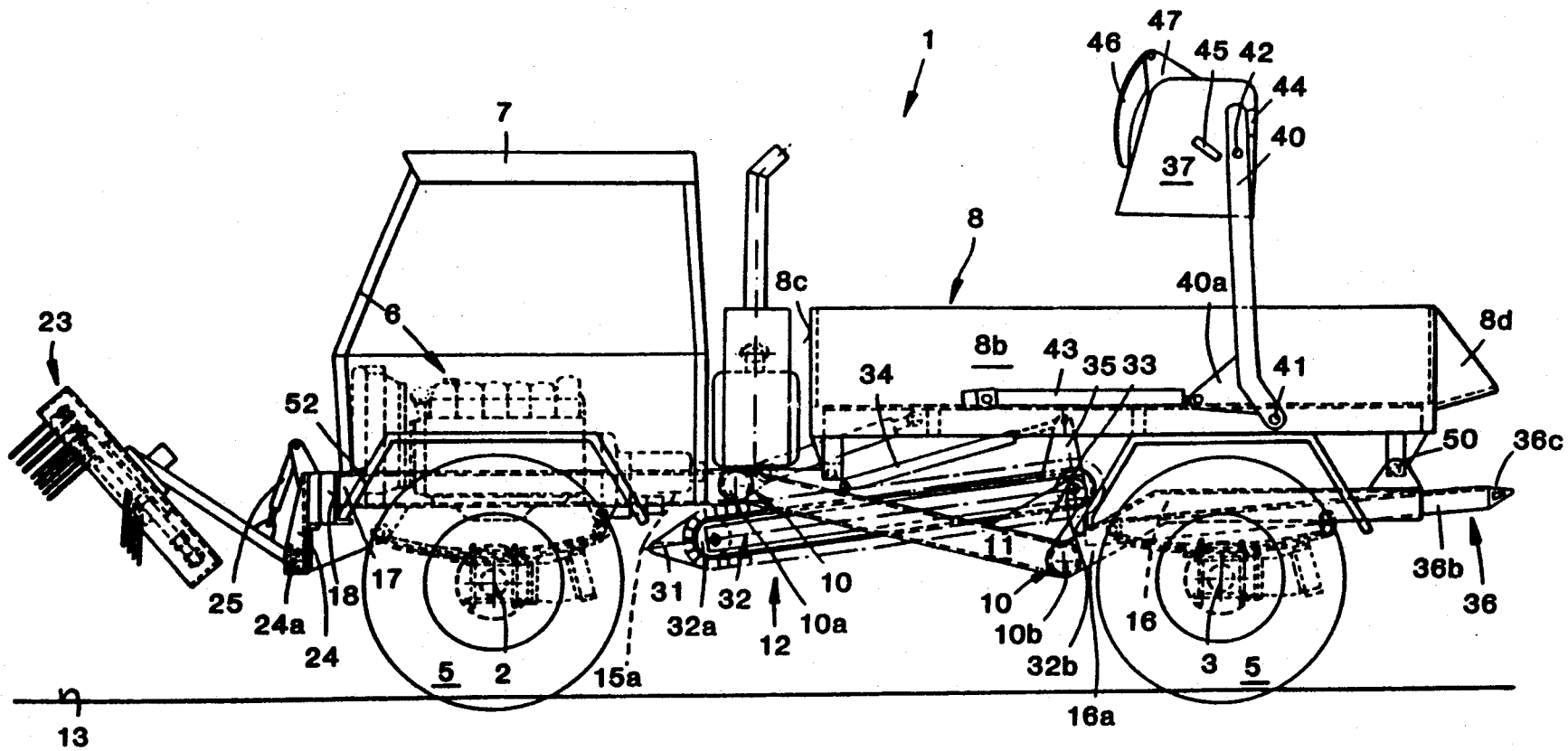
FIG. 7 shows a lateral view of the utility vehicle in its ready position.

The collecting receptacle is automatically emptied by a tipping over above the loading area 8 due to the eccentric mounting (FIG. 7).

A further actuator may moreover be provided between the lateral connecting rods 40 and the collecting receptacle 37 which allows a tilting of the collecting receptacle 37 independently of a pivoting of the connecting rods. Thus an emptying of the collecting rod is also possible in the position shown in FIG. 1. In this embodiment the rear wall 37*a* of the collecting receptacle is inclined in such fashion that the rear wall 37*a* and the bottom 13 are disposed approximately in parallel to each other in a rearwardly open garbage pickup position of the collecting receptacle. The collecting receptacle has moreover a level indicator which cooperates with an indicator means (not shown) disposed in the driver's cabin and indicates to the driver that the collecting receptacle is full.

A finisher 46 resting on the bottom 13 is pivotably linked to the rear of the collecting receptacle 37 by means of a mounting plate 47 fastened to the collecting receptacle according to FIG. 1. The finisher, however, may also be fastened to another part of the vehicle, in particular disposed behind the rear wheels, preferably to the vehicle frame 4. An actuator 48, e.g. a piston/cylinder unit, is mounted between the collecting receptacle 37 and the finisher 46 to adjust the inclination or to regulate the penetration depth of the finisher (only outlined schematically in FIG. 1).

As is shown in particular in FIGS. 1 and 7 to 9, the loading area 8 is disposed behind the driver's cabin and above the rear axle 3 and extends almost completely across the garbage pickup 12 and the conveying means 36. The loading area is of a rectangular design and consists essentially of a bottom wall 8*a*, two side walls 8*b* extending in the longitudinal direction of the vehicle, a front wall 8*c* and an adjustable rear wall 8*d*, which may also be designed as a discharge means. The loading area 8 is tiltable about a swivelling axis 50 located at the rear end of the rear axial longitudinal bar 16 by means of an actuator 49. The actuator 49 for tilting the loading area 8 is supported on the front transverse bar 10*a* and on the lower side of the bottom wall 8*a*. Rear wheel covers 51 for the rear wheels are affixed to the lower side of the bottom wall 8*a* and front wheel covers 52 for the front wheels are affixed to the driver's cabin 7 or to the front section 4*a* of the vehicle frame.

Figure 8:
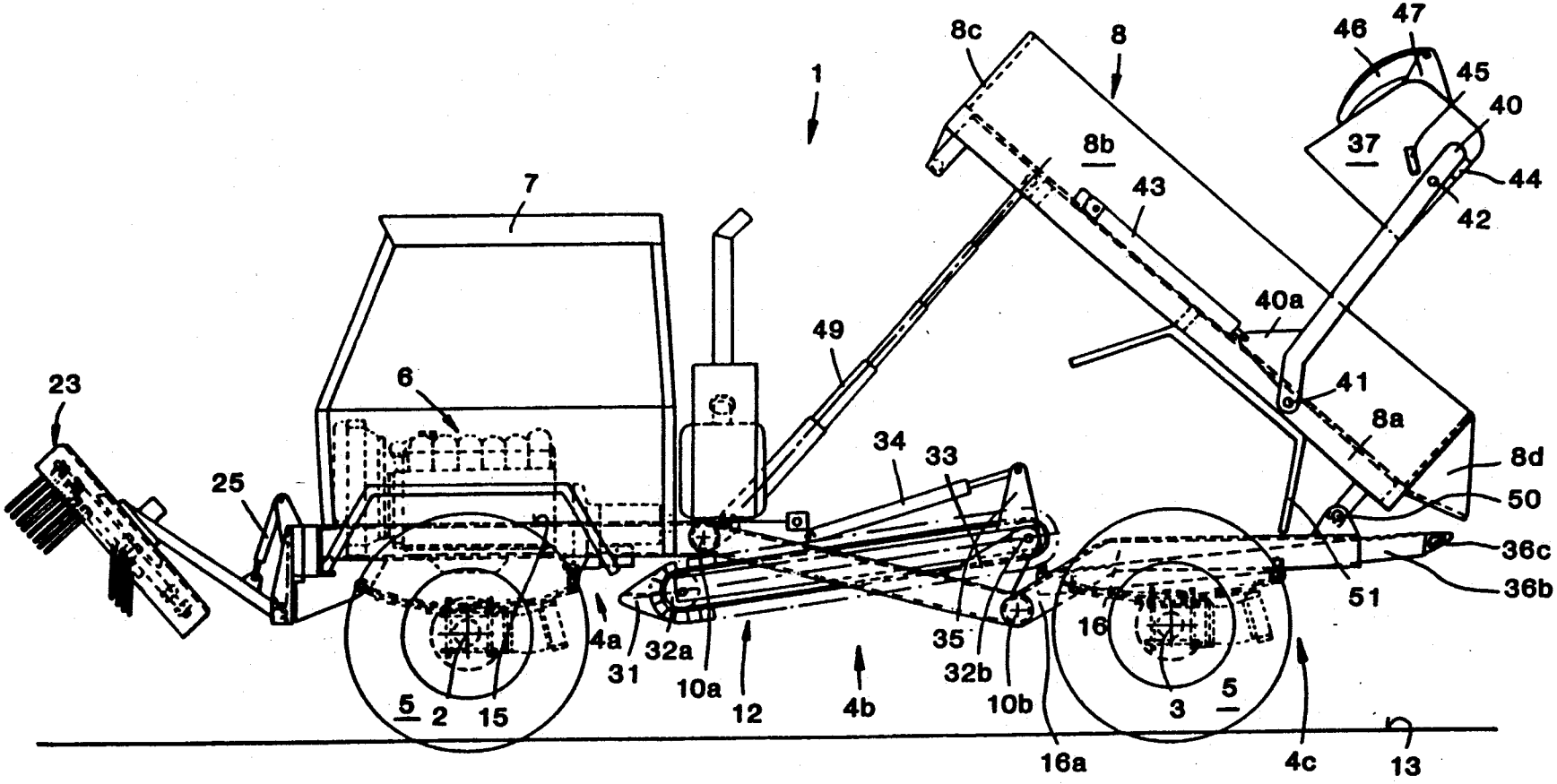
FIG. 8 shows a lateral view of the utility vehicle according to FIG. 7 with tilted loading area and FIG. 9 shows a lateral view of the utility vehicle for application cases other than beach cleaning.

The utility vehicle is represented with actuated actuator 49 and tilted loading area 8 in FIG. 8, the cleaning elements 23 and the garbage pickup 12 being disposed in the ready position where they are lifted from the bottom 13. For emptying the loading area 8 the collecting receptacle 37 is in the tilted position tilted away from the ground to the loading area due to an actuation of the actuator 43.

Figure 9:
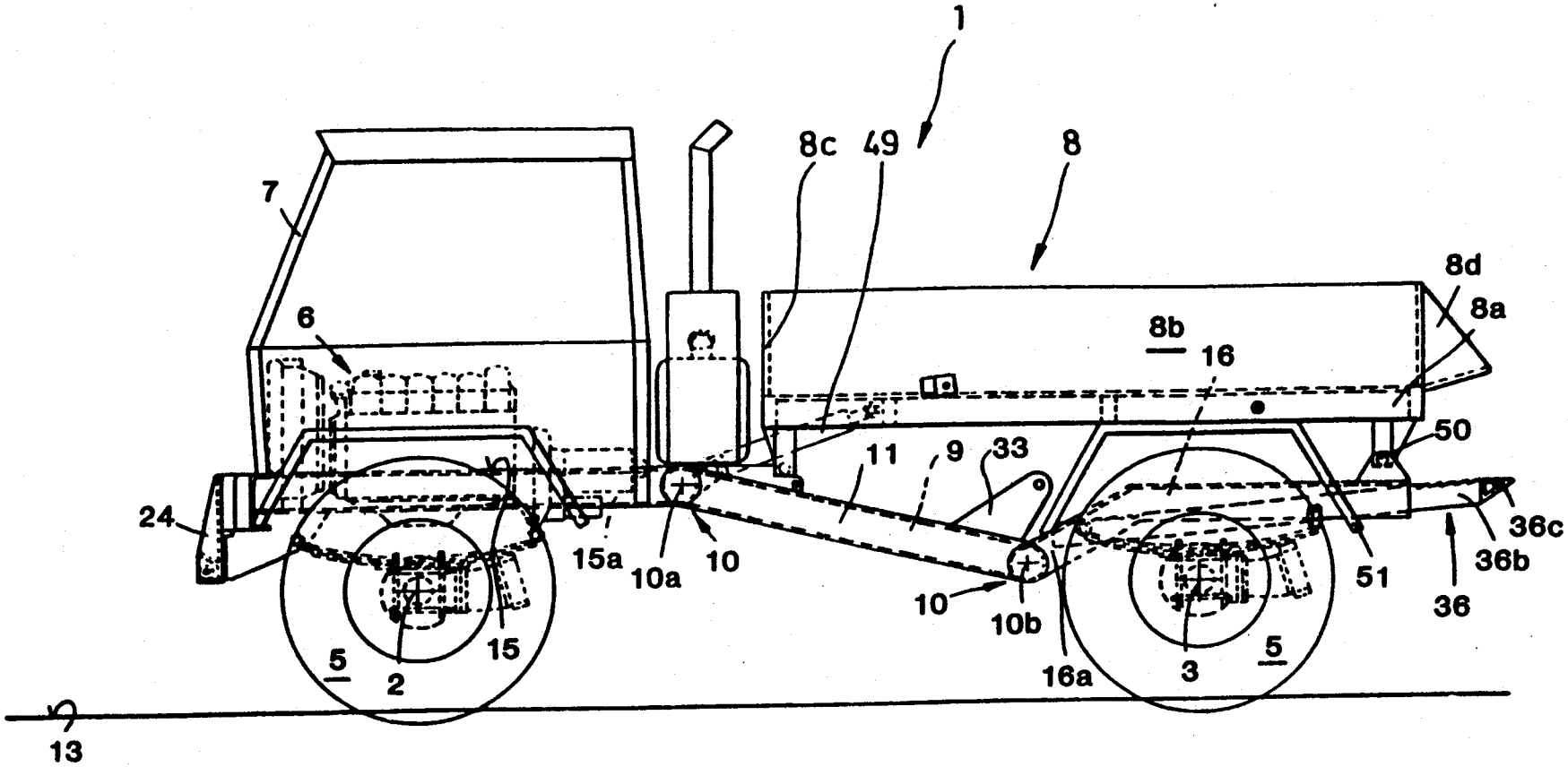

FIG. 9 shows the utility vehicle 1 with dismounted track cleaning means 20 and dismounted garbage pickup 12. It is furthermore possible to design the utility vehicle in such fashion that the conveying means 36 can also be detached from the vehicle. Detachable quick-acting closures are in each case provided for a quick dismounting of the track cleaning means 20, the garbage pickup 12, the collecting receptacle 37, the lateral connecting rods 40 and the finisher 46.

In order to be able to also use the utility vehicle for other purposes, in particular for municipal works, the vehicle may also be equipped with further attachment devices such as for the sweeping of tracks and roads, for the soil ventilation of meadows or the like. The following attachment devices may e g. be optionally fastened to the front side 1c of the utility vehicle: blade grass cutter, motorized grass cutter, sockle-bar grass cutter, side grass cutter, slope grass cutter, shredding device, sweeping machine, high-pressure flushing device (for tennis coards or plastics tracks), rotary brushes for the cleaning of guide posts and guardrails, snow ploughs. The attachment devices salt spreaders, fertilizer spreaders, soil ventilating devices (sports grounds, etc.) and lawn sweeping machines can e.g. be optionally attached to the rear of the vehicle 1b. The vehicle may moreover be provided with attachment devices, e.g. special facilities for the transport of wicker beach chairs, water reservoirs, etc. For this purpose, the quick-acting closure system, preferably on the front support 17 or on the attachment plate 18 of the vehicle, may be provided with an interchangeable plate having different bores for the attachment of the attachment devices.

What is now claimed is:

1. A self-propelled utility vehicle (1) for cleaning a ground surface comprising:

a vehicle frame (4) having a centric, rectangular opening (9) which has a loading area (8) disposed thereon and at least one front (2) and at least one rear axle (3) each equipped with at least one wheel (5);

an object pickup member (12), including a pickup V-ledge (31) for picking up objects and an elevator (32) for moving the objects, said pickup member pivotably coupled to said vehicle frame (1) proximate to said rectangular opening (9) so as to be adjustable between an operating position such that said pickup member (12) is in contact with the ground surface (13) and a ready position such that said pickup member (12) is above the ground (13) surface;

a collecting receptacle (37) disposed at the rear of said vehicle (1) and operable for collecting the objects which have been picked up and emptying same into said loading area (8); and conveying means (36), disposed between said pickup member (12) and said collecting receptacle (37), for conveying objects which have been picked up rearwardly into said collecting receptacle (37).

2. A vehicle according to claim 1, wherein the width of said object pickup member (12) corresponds at least to the width of a central strip (22) extending between said wheels (5) of said vehicle (1).

3. A vehicle according to claim 1, wherein said conveying means is disposed below said loading area and downstream from said elevator.

4. A vehicle according to claim 1, wherein said elevator (32) is disposed downstream of said pickup V-ledge (31).

5. A vehicle according to claim 4, wherein said elevator (32) comprises two deflecting axes (32a, b), the front one (32a) being disposed near the ground and the rear one (32b) being disposed at a distance from the ground in said operating position.

6. A vehicle according to claim 5, wherein said upper deflecting axis (32b), which is at a distance from the ground, is disposed above the rear axle (3) of said vehicle and/or above a rear transverse ar (10b).

7. A vehicle according to claim 5, wherein said elevator (32) is driven so as to move the objects rearwardly.

8. A vehicle according to claim 1, wherein an actuator (34) for adjusting and/or pivoting said object pickup member and for adjusting the working depth is provided between said vehicle frame (4) and said object pickup member (12).

9. A vehicle according to claim 1, wherein said elevator (32) is designed in the form of a conveyor belt, in particular a scraper floor, a raking belt or a link conveyor.

10. A vehicle according to claim 1, wherein a drivable conveyor means (36) is provided following said object pickup member (12), which conveys the picked up objects to the rear of said vehicle (1b).

11. A vehicle according to claim 10, wherein said conveyor means (36) is designed as a horizontal or rearwardly rising riddle sifter (36b).

12. A vehicle according to claim 10, wherein said conveyor means (36) is a conveyor belt.

13. A vehicle according to claim 1, wherein said collecting receptacle (37) is fastened to said vehicle (4) and/or to said loading area (8) of said vehicle by means of two lateral connecting rods (40).

14. A vehicle according to claim 13, wherein said connecting rods comprise at least one actuator (43) for pivoting about a horizontal swivelling axis (41).

15. A vehicle according to claim 13, wherein said collecting receptacle (37) is designed as a dump body and fastened to said connecting rods (40) by means of horizontal swivelling axes (42).

16. A vehicle according to claim 15, wherein the swivelling axes (42) are disposed before the gravity center of said collecting receptacle (37) in the direction of driving.

17. A vehicle according to claim 1, wherein said loading area (8) is disposed above said rear axle (3) behind a driver's cabin (7) and extends preferably across said object pickup member (12) and said conveyor means (36).

18. A vehicle according to claim 17, wherein said loading area (8) is tiltably mounted on said vehicle frame (4).

19. A vehicle according to claim 1, wherein a drivable track cleaning device (20) is provided at the front side (1c) of said vehicle (1), by means of which said objects located in the track can be conveyed towards the center of said vehicle (1d).

20. A vehicle according to claim 19, wherein said track cleaning device (20) is height-guided by means of guide shoes (26).

21. A vehicle according to claim 19, wherein said track cleaning device (20) and/or said object pickup member (12) are fastened by means of a detachable quick-acting closure.

* * * * *